US005220155A

United States Patent [19]

Cunningham

[11] Patent Number: 5,220,155

[45] Date of Patent: Jun. 15, 1993

[54] HEATING AND SENSING APPARATUS FOR RANGE TOP

[75] Inventor: Donald M. Cunningham, Pittsburgh, Pa.

[73] Assignee: Emerson Electric Co., St. Louis, Mo.

[21] Appl. No.: 849,890

[22] Filed: Mar. 12, 1992

[51] Int. Cl.[5] ..... H05B 3/74

[52] U.S. Cl. ..... 219/464; 219/465

[58] Field of Search ..... 219/464, 448, 449, 457, 219/458, 459, 462, 465, 497

[56] References Cited

U.S. PATENT DOCUMENTS

| | | | |
|---|---|---|---|
| 3,047,702 | 7/1962 | Lefebvre | 219/462 |
| 3,646,321 | 2/1972 | Siegla | 219/464 |
| 3,674,983 | 7/1972 | Hurko | 219/462 |
| 3,686,477 | 8/1972 | Dills | 219/462 |
| 3,805,023 | 4/1974 | Wainer | 219/464 |
| 3,805,024 | 4/1974 | Joeckel | 219/464 |
| 3,885,128 | 5/1975 | Dills | 219/462 |
| 4,507,546 | 3/1985 | Fortune | 219/497 |
| 4,946,198 | 3/1976 | Foote | 219/497 |

*Primary Examiner*—Teresa J. Walberg

*Attorney, Agent, or Firm*—Polster, Lieder, Woodruff & Lucchesi

[57] ABSTRACT

An electric range (R) has a glass/ceramic cooking top (S) upon which rests a cooking utensil. Electrical heating apparatus (10) has an electrical resistance heating element (12) to which an electrical current is supplied. This causes the heating element to generate heat. A heat sink (16) is interposed between the heating element and the cooking top for absorbing heat energy from the heating element and for spreading the energy under the surface area of the top by conduction. The heat sink is of an electrically insulative, translucent, aluminum nitride material or similar high thermal conductivity material. An insulation cake (20) supports the heating element and heat sink adjacent an underside of the cooking top and provides both electrical and thermal insulation. A pan (24) supports the insulation cake, the heating element (12) and the sink (16) in intimate contact with each other and the underside of the cooking top for maximum heat transfer by conduction. The heating element also functions as a temperature sensor responding with a change in electrical resistance to a change in temperature of the heating element as influenced by the cooking process. The change in electrical resistance is the input for an electronic control which prevents excessive temperature of the glass/ceramic cooking top.

22 Claims, 2 Drawing Sheets

HEATING AND SENSING APPARATUS FOR RANGE TOP

BACKGROUND OF THE INVENTION

This invention relates to appliance heating and control systems and, more particularly, to heating and sensing apparatus for use in ranges having glass/ceramic cooking tops.

Electric ranges having glass/ceramic cooking tops are well known in the art. While popular, these ranges have a number of limitations. One, for example, is that the glass/ceramic materials currently used in these appliances tend to limit the type of heating employed to radiant heating. This is because the material exhibits poor thermal conductivity qualities. Since, as a practical matter, radiant heating is not necessarily the most efficient way to heat for cooking purposes, this is a significant drawback. Second, the glass/ceramic material has an upper continuous temperature limit of approximately 1150 degrees F. (621 degrees C.). Third, the material becomes electrically conductive at temperatures above 800–1000 degrees F. (427–538 degrees C.). Consequently, the heating units must be closely monitored, and current flow to them stopped if the monitored temperature becomes too high. Otherwise, there is a potential danger of the glass/ceramic material losing those properties that are critical to this application.

It currently appears unlikely that these limitations will be overcome anytime soon. Therefore, it would be particularly advantageous if an alternate glass/ceramic heating system were available which is both efficient and cost effective; while or eliminating, or minimizing, the limitations found in current glass/ceramic range top designs.

SUMMARY OF THE INVENTION

Among the several objects of the present invention may be noted the provision of a heating and sensing apparatus for glass/ceramic electric range top; the provision of such apparatus utilizing materials having improved thermal and electrical properties than those used in conventional range tops; the provision of such material which permits heat energy transfer by conduction rather than by radiation; the provision of such apparatus having a heating unit which is smaller in size than conventional range surface units; the provision of a heating unit having less thermal inertia than conventional units so to provide a more efficient heat energy transfer than conventional range top designs thereby, for example, producing a significant improvement in boiling speed and efficiency; the provision of such apparatus employing materials having high thermal conductivity and which function as a heat sink or heat spreader when installed in a range top assembly; the provision of such of such materials which can also provide electrical insulation; the provision of such materials which are translucent; and, the provision of such apparatus which is simple in design, and easy to fabricate.

In accordance with the invention, generally stated, an electric range has a glass/ceramic cooking top upon which rests a cooking utensil containing items to be cooked. Electrical heating apparatus comprises an electrical heating element to which an electrical current is supplied. This causes the heating element to generate heat. A heat sink is interposed between the heating element and the cooking top for absorbing heat energy from the heating element and for spreading the energy over the surface area of the top by conduction. The heat sink is of an electrically insulative, translucent aluminum nitride material or other similar high thermal conductivity materials. An insulation cake supports the heating element and heat sink adjacent an underside of the cooking top and provides both electrical and thermal insulation. A pan supports the insulation cake, the heating element and the heat sink in intimate contact with each other and the underside of the cooking top for maximum heat transfer, this being by conduction. The heating element further functions as a temperature sensor, responding by a change in resistance to a change in temperature of the heating element as influenced by the cooking process. Changes in electrical resistance provides inputs for an electronic control which acts to prevent excessive temperature of the glass/ceramic cook top. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF PREFERRED EMBODIMENTS

Figure 1:
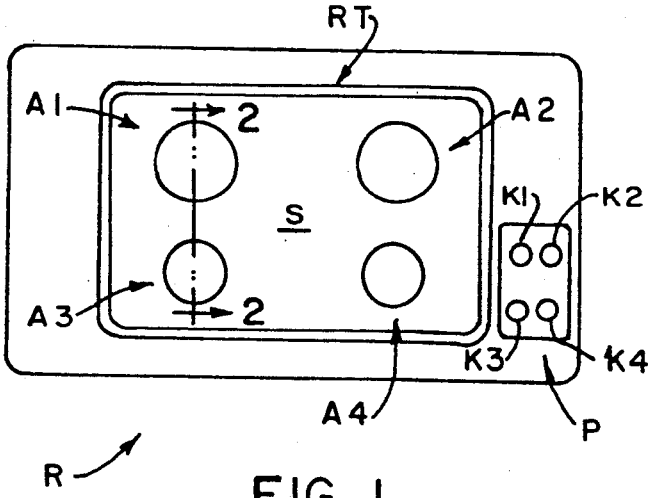
FIG. 1. PRIOR ART.
FIG. 1 is a top plan view of a range.

Referring to the drawings, a conventional electrical range is indicated generally R. The range may have an oven (not shown) and a range top RT on which pots, pans, or similar utensils for cooking food are placed. The range top has an upper section S which, as is well known in the art, is of a ceramic/glass construction. The cooking unit typically has a plurality of defined cooking areas four of which A1–A4 are shown in FIG. 1. These areas may be of the same size; or, some areas (A1 and A2) are larger than other areas (A3 and A4) so that different size pots and pans are more readily accommodated. A control panel P includes a control knob (K1–K4 respectively) for selecting the heating level of each area. While the control panel is shown on the top surface of the range in FIG. 1, it is understood that the panel is locatable in any of a number of convenient places on the range.

Figure 2:
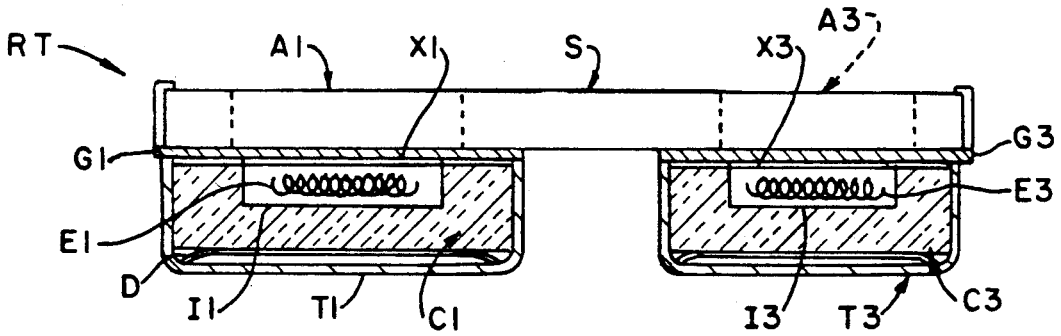
FIG. 2. PRIOR ART.
FIG. 2 is a sectional view of a conventional, prior art heating apparatus for a glass/ceramic top range.

Referring to FIG. 2, a cross-section of the range top includes the ceramic/glass upper section S of the cooking unit. Positioned beneath the cooking top is an open coil heating element E. Each separate heating area has its own associated heating element, elements E1 and E3 being shown in FIG. 2. The construction of these type elements is known in the art and is therefore not described. Each heating element is positioned in a large diameter cavity I formed in an insulation "cake" C. This cake, in turn, is mounted in a pan or support T to which the top section of the cooking unit may also be attached to form an integral assembly. A spider D positioned in the bottom of the pan is made of a spring material to bias the heating element upwardly toward the range top. A gasket G is used to seal the top of the pan/cake/coil assembly from the cooking top. In any event, the cake is of a suitable insulative material. Mounted above the cavity and extending the length of section S is temperature sensing rod X which is electrically connected in the circuit by which current is applied to the various heating coils. Heating elements E radiate heat to the cooking area A with which they are associated. However, radiate heating is not a particularly efficient manner of heat transfer for cooking purposes. In addition, conventional glass/ceramic cooking top materials become electrically conductive above a temperature of approximately 800° F. to 1000° F. (427 C.-538 C.).

Figure 3:
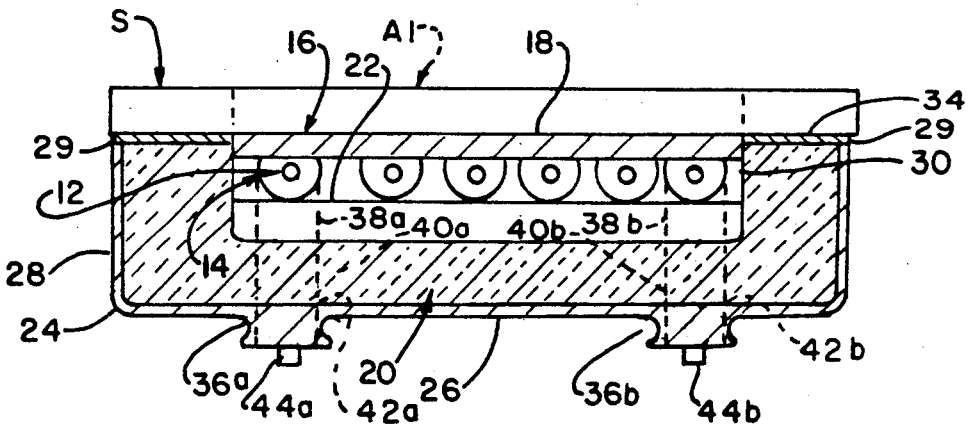
FIG. 3 is a sectional view of a first embodiment of the apparatus of the present invention.
Figure 4:
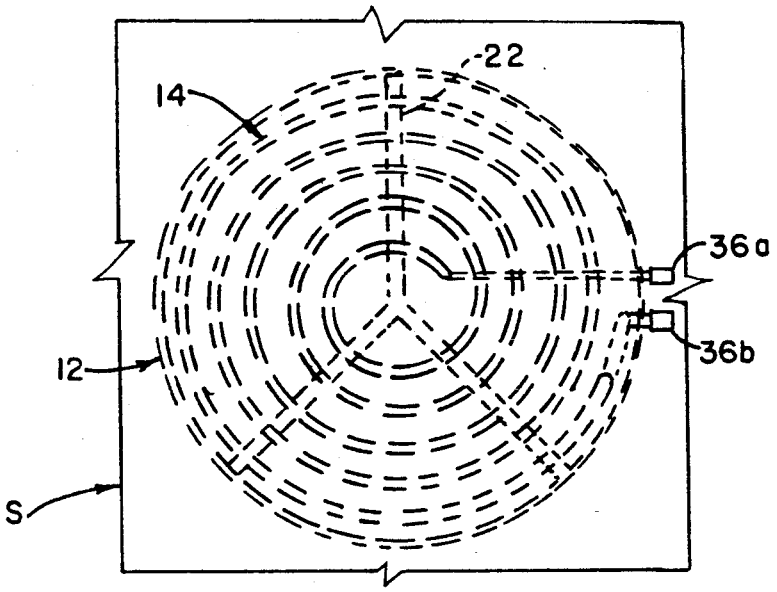
FIG. 4 is a top plan view of a heating element of the apparatus.

Referring now to FIG. 3, electrical heating apparatus 10 of the present invention is for use in an electric range R having a glass/ceramic type cooking top RT. The apparatus first includes electrical heating means 12 to which an electrical current is supplied and which generates heat energy in response thereto. As shown in FIGS. 3 and 4, heating means 12 comprises a metal sheath heating element 14. The metal sheath is shown to form a helical shaped heating element in FIG. 4; although it will be understood that other forms or shapes could also be used without departing from the scope of this invention. Heating element 14 is, for example, 0.19 inch (0.48 cm.) in diameter, and is made using an internal resistance wire having a positive temperature coefficient (PTC) of resistances. Appropriate wire would, for example, be a nickel (Ni) alloy or PTC wire. The element is smaller in size than conventional metal sheath heating elements. Because of this, heating element 14 exhibits less thermal inertia than standard metal sheath heating elements. This enables heating element 14 to reach its desired temperature faster, thereby reducing overall cooking time. It also improves the boiling speed and efficiency of the range, and provides secondary insulation in the event of glass/ceramic top S breaking due to an impact.

Next, apparatus 10 employs heat sink means indicated generally 16 for absorbing heat energy from heating element 14. Means 16 comprises a disc 18 which is preferably of a translucent, aluminum nitride (AlN) material. Disc 18 is proximately positioned to both heating element 14 and the glass/ceramic upper section S of range R. As seen in FIG. 3, the disc is sandwiched between the two. The result is that heat is transferred from the heating element to the disc by conduction, and from the disc to the heating area A also by conduction. This manner of spreading heat energy over the surface area of the cooking top by conduction is much more efficient than by the previous radiation methods. Due to this increase in cooking efficiency, the overall cost of operating the range is lowered.

The heating means and heat sink means are supported in insulation means 20. This insulation means, in turn, is installed in a support means 24. The support means comprises a shallow pan having a bottom 26 and sidewalls 28. The insulation means includes a cake of insulative material which is, for example, a microporous fumed silica material. The cake has an integrally formed spider 22 and gasket 29. A shallow cavity 30 is formed in the upper surface of the cake. Heating element 14 and heat sink disc 18 are installed in each insulation cake 20 and pan 24 sub-assembly. Heating element 14 rests upon the integrally formed spider 22, and heat sink disc 18 sits atop the heating element. When heating element 14 and heat sink disc 18 are mounted in the cavity, the upper surface of the heat sink disc is slightly above the upper surface 34 of the insulation cake. Further, the depth of pan 24 corresponds to the height of the insulation cake so upper surface 34 of the cake is slightly above the upper end of pan sidewall 28.

Electrical terminals 36*a*, 36*b* for the heating element are attached to the ends of the element and extend through a sidewall 28 or bottom 26 of pan 24 (see FIG. 4). Each heating element 14 further has electrical conductors 38*a*, 38*b* integrally formed with the element. To facilitate installation of pan 24 on the underside of the cooking top S, insulation cake 20 and pan 24 have respective aligned openings 40*a*, 40*b*, and 42*a*, 42*b* through which the respective legs of metal sheath heating element extend when the heating element is inserted into the cake and pan. After the complete assembly is in-place, electrical lines 44*a*, 44*b* are attached to the outer end of the heating element terminals to complete an electrical circuit through the heating element. In addition to providing a heating element for range R, means 12 further serves as a temperature sensing element. As such, an electronic controller (not shown) for the range can sense, for example, the electrical resistance of the heating element. The controller can be programmed so that it reads the element's resistance value as AC voltage crosses a "zero-level". If the corresponding temperature is above that which it should not go, the controller can open the electrical circuit through the heating element. This temperature setting is such as to insure that the temperature of cooking top S does not exceed a safe level for the ceramic/glass material. Above this level, the material will lose those properties which make it suitable for the application as a cooking top.

Figure 5:
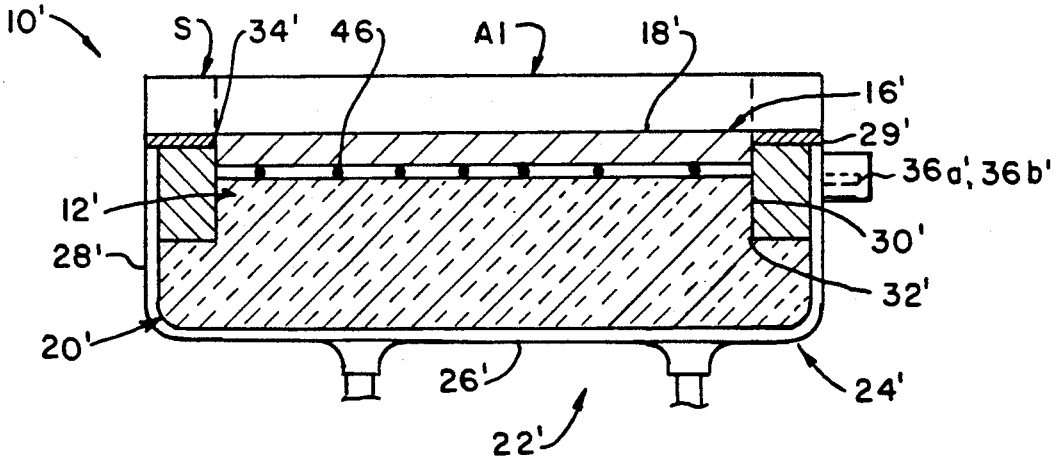
FIG. 5 is a sectional view of a second embodiment of the apparatus.
Figure 6:
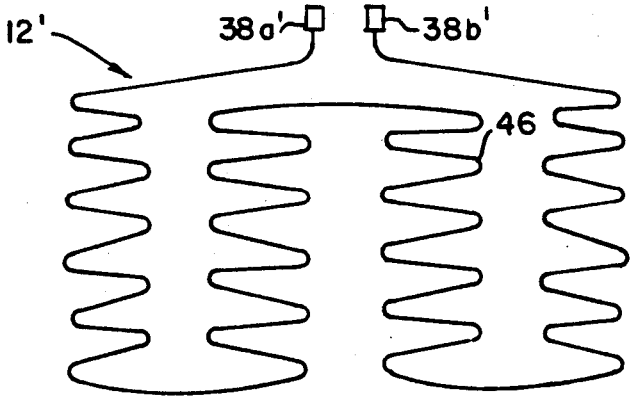
FIGS. 6 is a top plan of a heating element used with the second embodiment.

Referring to FIGS. 5 and 6, an alternate embodiment 10' of the heating apparatus includes electrical heating means 12' to which an electrical current is supplied and which generates heat energy in response thereto. Unlike the metal sheath heating element 14, heating means 12' comprises a sinuous resistance wire 46. As shown in FIG. 6, the wire has a general S shape when viewed in plan. It will understood, however, that the wire could have other shapes without departing from the scope of the invention. Heating element 46 is, for example, made of a resistance wire having a positive coefficient of resistance with increase in temperature. Element 46 is smaller in size than prior art helical coil type heating elements. Heating element 46 exhibits less thermal inertia than these conventional heating elements, or even heating element 14. Again, this allows element 46 to reach a desired temperature quicker than in prior art constructions.

Apparatus 10' utilizes heat sink means indicated 16' for absorbing heat energy from heating element 14'. Means 16' is a disc 18' which, like disc 18, is a translucent, aluminum nitride (AlN) material or other material having high thermal conductivity. Disc 18' mounts between heating element 12, and the glass/ceramic section S of range R. As before, heat is transferred from the heating element to the disc by conduction, and from the disc to heating area A by conduction. Again, using this more efficient method of heat transfer, the overall cost of operating the range is improved. In this alternate embodiment the disc 18 also provides the electrical insulation between wire 46 and section S.

Apparatus 10' includes an insulation means 20' which is installed in a support means 22'. The support means is a shallow pan 24' with a bottom 26' and sidewalls 28'. Insulation means 20' is a cake of microporous fumed silica insulative material or other material having a low "K" factor. The cake may have a plurality of circular, shallow cavities such as with the cake of the previous embodiment. These cavities being formed in its upper surface. However, the grooves can be eliminated so to accommodate a wider variety of winding patterns and to lower cost. In this instance then, the cake will have a single large cavity 30' or no cavity. Heating element 12 and heat sink disc 18' are installed on or in each cake. Wire 46 is installed atop disc 32', and heat sink 16' rests on top of the wire. Disc 32' is sufficiently thick that when wire 46 and disc 18' are installed in cavity 30', the upper surface of the heat sink disc is slightly above the upper surface 34' of the insulation cake. Further, the height of pan 24' is slightly less than that of the insulation cake. The upper surface of the cake is thus slightly above the upper end of pan sidewall 28'.

Apparatus 10' may also include a gasket 29' which comprises a sealing element extending around the circumference of the cake. The gasket fits inside sidewall 28' of pan 24' and is compressed between a top surface 34' of the cake and the underside of glass/ceramic section S. It will be understood, however, that neither gasket 29 of the previous embodiment, or gasket 29', may be used. Rather, if the vertical sidewall of the insulation cake can be sufficiently compressed to form a requisite seal, the use of a separate gasket is not required.

The apparatus further includes electrical terminals **36*a'*, 36*b'* electrically insulated from the bottom or side of the pan. The terminals are used to electrically connect wire 46 in an electrical circuit. Conductors 38*a'*, 38*b'* are located along the length of wire 46 and extend downwardly. The insulation cake has openings 42*a'* and 42*b'* through which the electrical conductors extend when the heating wire is inserted into cavity 30'. Conductors 38*a'*, 38*b'* are routed through these vertical openings in the insulation cake to allow the conductor ends to attach to respective terminals 36*a'*, 36*b'* when wire 46 is put in place. Once the pan is mounted beneath the cooking top, electrical lines 44*a'*, 44*b'* are attached to the outer end of the terminals to complete an electrical circuit which includes heating wire 46. As with heating element 14, wire 46** acts as a temperature sensor element. Operation of the wire, as a sensor, is with an electronic controller which senses the electrical resistance of the wire. Again, the controller may be programmed so it reads the element's resistance value as AC voltage crosses a "zero-level". If the temperature is above a predetermined temperature, the controller opens the electrical circuit through the heating element. The temperature setting insures the cooking top temperature does not exceed a safe level.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. Electrical heating apparatus for use in an electric range having a glass/ceramic type cooking top comprising:

electrical heating means to which an electrical current is supplied and which generates heat energy in response thereto;

heat sink means for absorbing heat energy from the heating means and for spreading the energy over the surface area of the underside of the top by conduction, the heat sink means being of a translucent material;

support means for supporting the heating means and heat sink means adjacent the underside of the cooling top; and, insulation means interposed between the heating means and the support means for providing thermal insulation and electrical insulation.

2. The apparatus of claim 1, wherein the heating means comprises a metal sheath heating element.

3. The apparatus of claim 2 wherein the metal sheath forms a helical shaped heating element.

4. The apparatus of claim 1 wherein the heating means comprises a sinuous resistor heating element.

5. The apparatus of claim 1 wherein the heat sink means is of an aluminum nitride material.

6. The apparatus of claim 1 wherein the insulation means comprises an insulation cake formed of a porous, insulative material.

7. The apparatus of claim 3 wherein the cake has a cavity formed therein in which the heating means is positioned.

8. The apparatus of claim 1 further wherein the heating means further comprises means for indirectly sensing the temperature of the apparatus by means of a change in electrical resistance and for disrupting flow of current to the heating means if the temperature exceeds a predetermined value.

9. The apparatus of claim 1 further including gasket means installable in the support means to form a seal with the cooking top.

10. Electrical heating apparatus for use in an electric range comprising:

a glass/ceramic cooking top upon which items to be cooked are placed;

electrical heating means to which an electrical current is supplied and which generates heat energy in response thereto, the heating means being positioned beneath the cooking top in a spaced relationship therewith;

heat sink means interposed between the heating means and the cooking top for absorbing heat energy from the heating means and for spreading the energy over the surface area of the top by conduction, the heat sink means being electrically insulative;

support means for supporting the heating means and heat sink means adjacent the underside of the cooking top; and, insulation means interposed between the heating means and the support means for providing thermal insulation and electrical insulation.

11. The apparatus of claim 10 in which the heating means a metal sheath heating element and the heat sink means comprises a translucent material.

12. The apparatus of claim 11 wherein the heating element is helical shaped.

13. The apparatus of claim 11 wherein the heat sink means if of an aluminum nitride material.

14. The apparatus of claim 11 wherein the insulation means comprises a porous insulation cake having a cavity formed therein in which the heating means is positioned.

15. The apparatus of claim 10 wherein the heating means further comprises means for indirectly sensing the temperature of the apparatus by means of a change in electrical resistance and for disrupting flow of current to the heating means if the temperature exceeds a predetermined value.

16. The apparatus of claim 10 further including gasket means installable in the support means to form a seal with the cooking top.

17. In an electric range having a glass/ceramic cooking top upon which items to be cooked are placed, the improvement of electrical heating apparatus comprising electrical heating means to which an electrical current is supplied and which generates heat energy in response thereto, the heating means being positioned beneath the cooking top in a spaced relationship therewith; heat sink means interposed between the heating means and the cooking top for absorbing heat energy from the heating means and for spreading the energy over the surface area of the top by conduction, the heat sink means being of an electrically insulative aluminum nitride material; support means for supporting the heating means and heat sink means adjacent the underside of the cooking top; and, insulation means interposed between the heating means and the support means for providing thermal insulation and electrical insulation, the heating means further sensing the temperature of the apparatus for disrupting flow of current to the heating means if the temperature exceeds a predetermined value.

18. The improvement of claim 17 wherein the heating means comprises a helically shaped metal sheath heating element.

19. The improvement of claim 17 wherein the heating means comprises a sinious sinous resistor heating element.

20. The improvement of claim 17 wherein the heat sink means is translucent.

21. The improvement of claim 17 wherein the insulation means comprises a porous insulation cake having a cavity formed therein in which the heating means is positioned.

22. The improvement of claim 17 further including gasket means installable in the support means to form a seal with the cooking top.

* * * * *

UNITED STATES PATENT AND TRADEMARK OFFICE

CERTIFICATE OF CORRECTION

PATENT NO. : 5,220,155

DATED : June 15, 1993

INVENTOR(S) : Donald M. Cunningham

It is certified that error appears in the above-indentified patent and that said Letters Patent is hereby corrected as shown below:

Column 6, line 26, delete "3" and insert therefor ---6---;
Column 6, line 61, after "means" insert therefor ---comprises---;
Column 6, line 65, delete "11" and insert therefor ---12---;
Column 3, line 9, delete "radiate" and insert therefor ---radiant---;
Column 4, line 57, delete "12" and insert therefor ---12'---;

Signed and Sealed this

Sixteenth Day of August, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,220,155

DATED : June 15, 1993

INVENTOR(S) : Donald M. Cunningham

It is certified that error appears in the above-indentified patent and that said Letters Patent is hereby corrected as shown below:

Col. 4, line 57
replace "12 ,"
with --12'--.

Col. 8, line 13 delete "sinous".

Signed and Sealed this

Twenty-first Day of July, 1998

Bruce Lehman

*Attest:*

BRUCE LEHMAN

*Attesting Officer*

*Commissioner of Patents and Trademarks*